US006547120B1

(12) United States Patent
Popovich et al.

(10) Patent No.: US 6,547,120 B1
(45) Date of Patent: Apr. 15, 2003

(54) POWDER DRIVEN FASTENER SETTING TOOL

(75) Inventors: Michael S. Popovich, Bartlett, IL (US); Edward D. Yates, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 106 days.

(21) Appl. No.: 09/689,095

(22) Filed: Oct. 12, 2000

(51) Int. Cl.[7] ..... B25C 1/14
(52) U.S. Cl. ..... 227/10; 227/9; 227/136
(58) Field of Search ..... 227/10, 9, 11, 227/136, 75.02; 42/75.02

(56) References Cited

U.S. PATENT DOCUMENTS

| | | | | | |
|---|---|---|---|---|---|
| 329,366 | A | * | 10/1885 | Crisp | 227/136 |
| 3,067,454 | A | * | 12/1962 | Catlin et al. | 42/1.12 |
| 3,554,425 | A | * | 1/1971 | Oesterle | 227/10 |
| 3,609,901 | A | * | 10/1971 | Necas | 42/1.12 |
| 3,891,133 | A | * | 6/1975 | Maier et al. | 227/10 |
| 4,200,216 | A | * | 4/1980 | Maier | 227/126 |
| 4,804,127 | A | * | 2/1989 | Kirkman | 227/10 |
| 5,299,373 | A | * | 4/1994 | Breiner | 42/15 |
| 5,363,736 | A | * | 11/1994 | Huang | 227/10 |
| 5,425,488 | A | | 6/1995 | Thompson | |
| 5,429,291 | A | | 7/1995 | Thompson | |
| 5,465,893 | A | | 11/1995 | Thompson | |
| 5,518,161 | A | | 5/1996 | Thompson | |
| 5,934,162 | A | * | 8/1999 | Habermehl | 227/136 |
| 5,992,723 | A | * | 11/1999 | Lee | 227/10 |
| 6,059,162 | A | | 5/2000 | Popovich et al. | |
| 6,126,055 | A | * | 10/2000 | Gantner et al. | 227/10 |
| 6,272,782 | B1 | | 8/2001 | Dittrich et al. | |
| 6,343,535 | B1 | * | 2/2002 | Gaudron | 227/10 |
| 6,378,752 | B1 | | 4/2002 | Gaudron | |

* cited by examiner

*Primary Examiner*—Rinaldi I. Rada
*Assistant Examiner*—Louis Tran
(74) *Attorney, Agent, or Firm*—Lisa M. Soltis; Mark W. Croll; Donald J. Breh

(57) ABSTRACT

A compression triggered powder driven fastening tool having a firing mechanism with a sleeve axially movable between first and second positions, a lever cam coupled to the sleeve or some other reciprocating portion of the tool and movable therewith, an indexing lever pivotally coupled to the tool, the indexing lever having a magazine strip engagement portion extending into a magazine channel of the tool, the indexing lever having a cam follower portion engaged with the lever cam, the magazine strip engagement portion of the indexing lever moves between first and second positions in the magazine channel as the sleeve moves with the reciprocating portion of the tool to which it is coupled, the magazine engagement portion of the indexing lever indexes a magazine strip through a channel of the tool.

20 Claims, 3 Drawing Sheets

POWDER DRIVEN FASTENER SETTING TOOL

BACKGROUND OF THE INVENTION

The invention relates generally to powder actuated tools, and more particularly to powder actuated fastener setting tools having automatic magazine strip indexing.

Powder actuated fastener setting tools are known generally. U.S. Pat. No. 5,429,291 entitled "Compression Actuated Tool For Driving Fasteners" assigned commonly with the present application, for example, discloses a powder driven tool including a manually operated spring biased indexing lever pivotally mounted thereon for advancing a magazine strip retaining a plurality of powder cartridges therein through a magazine channel of the tool.

An object of the present invention is to provide novel fastener setting tools that improve upon and overcome problems in the art.

Another object of the invention is to provide in some embodiments thereof novel fastener setting tools that are economical.

Another object of the invention is to provide in some embodiments thereof novel fastener setting tools that are reliable.

A further object of the invention is to provide in some embodiments thereof novel compression triggered fastener setting tools.

Another object of the invention is to provide in some embodiments thereof novel compression triggered fastener setting tools that are easy to operate.

It is also an object of the invention to provide in some embodiments thereof novel powder actuated fastener setting tools having improved cartridge magazine indexing.

Another object of the invention is to provide in some embodiments thereof novel powder actuated fastener setting tools that are easy to operate.

Another object of the invention is to provide in some embodiments thereof novel powder actuated fastener setting tools having improved magazine strip advancement.

Another object of the invention is to provide in some embodiments thereof novel powder actuated fastener setting tools having precise magazine strip advancement.

Another object of the invention is to provide in some embodiments thereof novel powder actuated fastener setting tools that do not require manual magazine strip advancement.

Another object of the invention is to provide in some embodiments thereof novel powder actuated fastener setting tools having automatic magazine strip advancement.

Another object of the invention is to provide in some embodiments thereof novel compression triggered powder actuated fastener setting tools having magazine strips that advance during reciprocation of a compression triggered firing mechanism.

A more particular object of the invention is to provide in some embodiments thereof novel compression triggered powder driven fastening tools comprising a firing mechanism having a sleeve axially movable between first and second positions, a lever cam coupled to the sleeve and movable therewith, an indexing lever pivotally coupled to the tool, the indexing lever having a magazine strip engagement portion extending into a magazine channel of the tool, the indexing lever having a cam follower portion cammingly engaged with the lever cam, the magazine strip engagement portion of the indexing lever in a first position in the magazine channel when the sleeve is in the first position, and the magazine strip engagement portion of the indexing lever in a second position in the magazine channel when the sleeve is in the second position.

Another more particular object of the invention is to provide in some embodiments thereof novel powder driven fastener setting tools comprising a lever cam movable between first and second positions, an indexing lever pivotally coupled to the tool, an engagement portion of the indexing lever extending into the magazine channel, a cam follower portion of the indexing lever engaged with the lever cam as the lever cam moves between the first and second positions.

Yet another more particular object of the invention is to provide in some embodiments thereof novel improvements in powder actuated fastener setting tools having a magazine strip fed through a channel, the improvement comprising a lever cam coupled to a reciprocating trigger mechanism sleeve and movable therewith between first and second positions, an indexing lever pivotally coupled to the tool, a ratcheting magazine engagement portion of the indexing lever extending into the magazine channel, a cam follower portion of the indexing lever engaged with the lever cam as it moves between the first and second positions, the magazine engagement portion of the indexing lever located in a first position in the channel when the lever cam is in the first position, and the magazine engagement portion of the indexing lever located in a second position in the channel when the lever cam is in the second position, whereby the ratcheting magazine engagement portion of the indexing lever indexes the magazine strip through the channel.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Generally, a magazine strip or some other member is incrementally indexed through a channel of a fastening tool by an indexing lever actuated by a lever cam that moves between first and second positions with some other portion of the tool.

Figure 1:
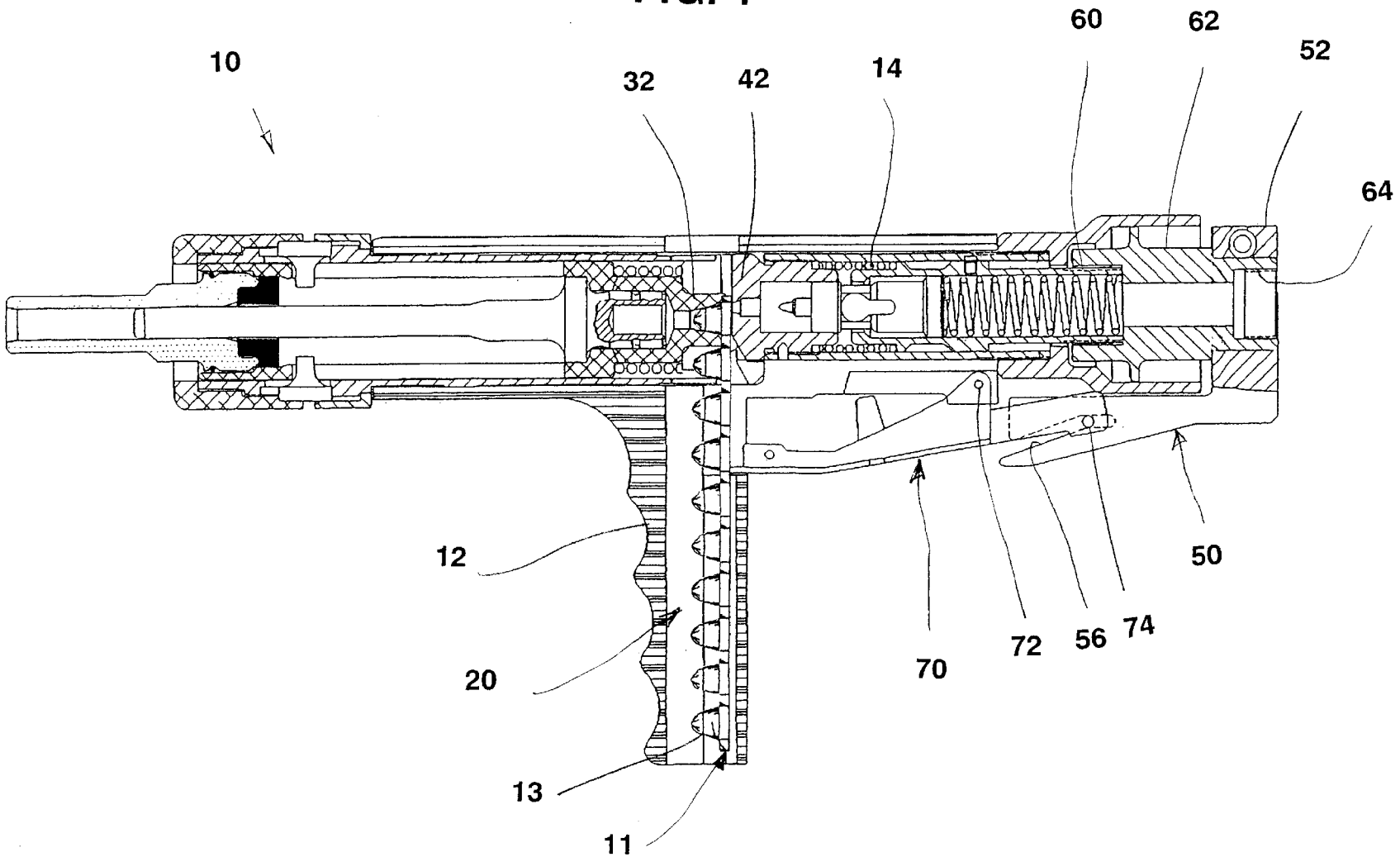
FIG. 1 is partial sectional view of an exemplary powder actuated tool in a first configuration.

In the exemplary powder driven fastener setting tool 10 of FIG. 1, a magazine strip 11 is fed or indexed along a magazine channel 20 disposed in a pistol-type grip 12 of the tool. The magazine channel 20 extends to and through a firing chamber disposed between a barrel breech end 32 and a breech block 42 of the tool.

The magazine strip 11 retains a plurality of spaced apart explosive cartridges 13 that are sequentially positioned in alignment with a cartridge recess in the breech end of the barrel, for accommodation therein during detonation, as the magazine strip is indexed through the magazine channel.

In other embodiments, the magazine channel may be configured differently, and more generally it may be any passage, or channel, in the tool through which it is desirable to move, or index, a magazine strip or some other member.

In FIG. 1, a lever cam 50 is coupled to a compression triggering mechanism of the tool 10, and more particularly to a spring biased sleeve 60 that reciprocates between first and second positions during operation of the tool.

The firing mechanism sleeve is aligned substantially axially with the barrel of the tool and reciprocates along its axis upon compression thereof against the spring bias.

Figure 2:
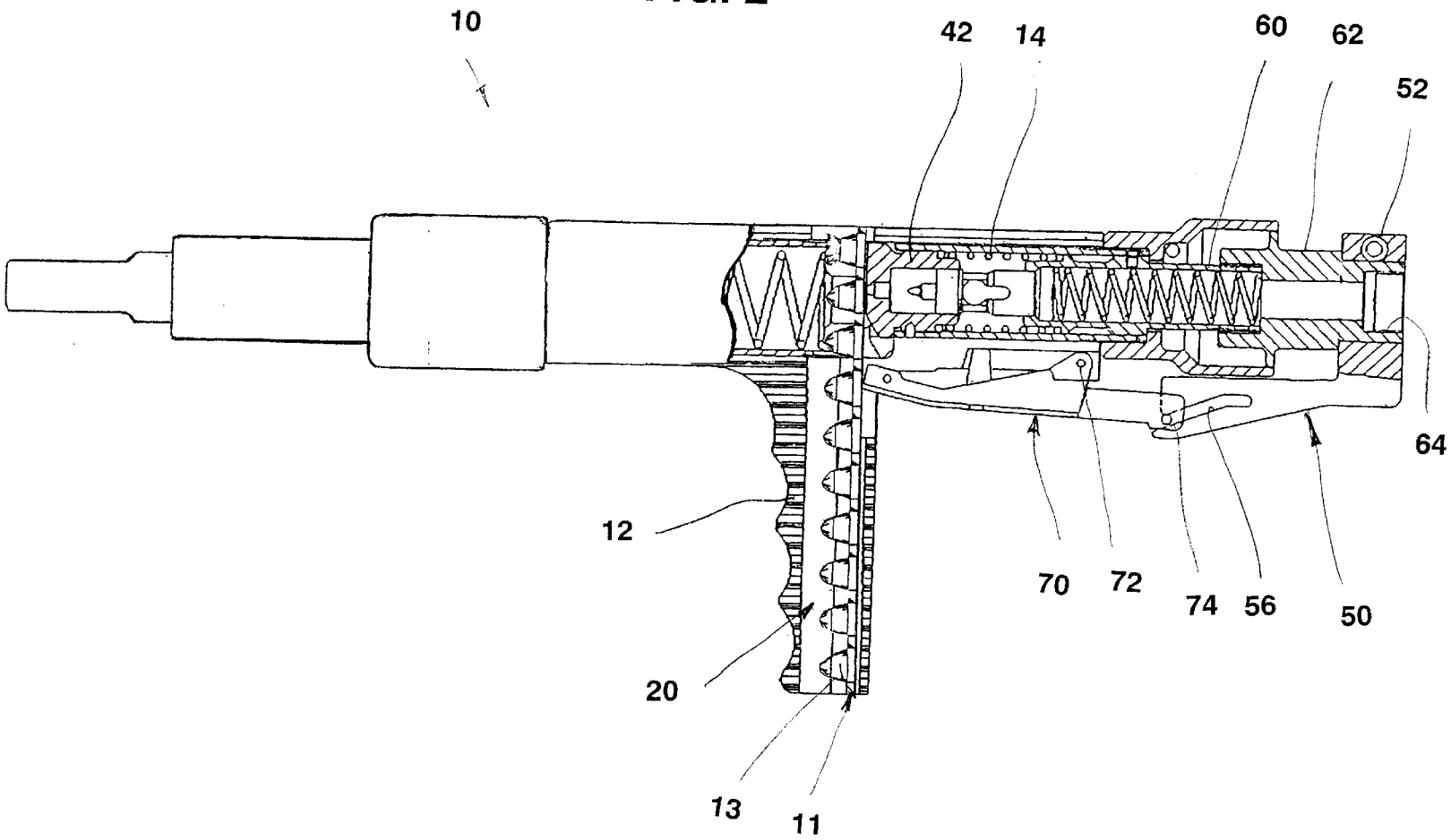
FIG. 2 is partial sectional view of the exemplary powder actuated tool in a second configuration.

Particularly, in FIG. 2, a spring 14 disposed between the breech block 42 and the sleeve 60 biases the sleeve to the first position when the spring is relatively expanded. The sleeve is movable to the second position against the spring bias, as illustrated in FIG. 1, upon application of an axial compression force thereto as is known generally by those having ordinary skill in the art.

Alternative exemplary compression triggering mechanisms in powder driven fastener setting tools are known generally and the operation thereof is disclosed more fully, for example, in the referenced U.S. Pat. No. 5,429,291 entitled "Compression Actuated Tool For Driving Fasteners", the disclosure of which is incorporated herein by reference.

In FIGS. 1 and 2, the lever cam 50 extends from an integral flange 52 that is coupled, for example by screw thread or other engagement, to the sleeve 60 and particularly to a handle portion 62 thereof. The exemplary handle portion 62 is assembled with the sleeve 60 and abuts a firing pin actuating spring within the sleeve.

The exemplary handle portion 62 includes an optional pole connector 64, to which may be coupled, for example by screw thread or other engagement, an extension pole.

Alternatively, the handle portion 62 may be formed integrally with the sleeve 60, or the handle portion 62 may be formed integrally with the flange 52 and the lever cam 50.

In other embodiments, the handle portion 62 and flange 52 may not be required, for example in embodiments that do not include a firing pin actuating spring. In this embodiment, the lever cam is an integral part of or is coupled directly to the sleeve or to some other member coupled thereto extending axially from the rear end portion of the tool.

In still other alternative embodiments, the lever cam 50 may be coupled to some other reciprocating portion of the tool, for example to the barrel thereof.

The tool also comprises an indexing lever 70 pivotally coupled thereto, for example by a pivot pin 72 or some other pivoting member or members. The indexing lever generally comprises a magazine engagement portion and a cam follower portion disposed on generally opposite sides of the pivot pin in the exemplary embodiment.

The cam follower portion of the indexing lever is cammingly engaged with the lever cam as the lever cam moves between first and second positions in unison with the reciprocating portion of the tool to which it is coupled, thereby pivoting the indexing lever.

In FIGS. 1 and 2, the lever cam 50 includes a ramped cam slot 56, and the cam follower portion of the indexing lever 70 includes a lever pin 74 that is disposed in and follows the ramped cam slot 56 as the lever cam 50 moves with the sleeve between the first and second positions. Particularly, the lever pin 74 moves between first and second positions along the ramped cam slot 56 as the lever cam 50 moves between its first and second positions in unison with the reciprocating portion of the tool to which it is coupled.

Generally, the magazine engagement portion of the indexing lever extends into the magazine channel where it engages and indexes the magazine strip during movement of the indexing lever toward the firing chamber.

Figure 3:
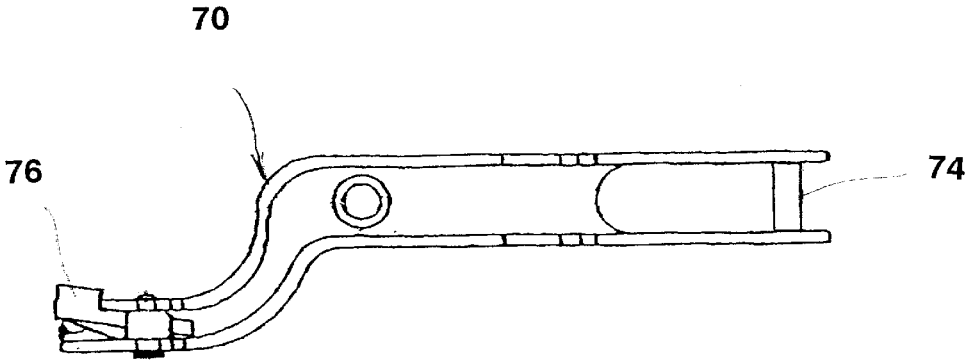
FIG. 3 is a top view of an exemplary magazine strip indexing lever.

FIG. 3 illustrates the exemplary indexing lever 70 having a known ratcheting magazine engagement portion with a spring biased tooth 76 for engaging the magazine strip. In other embodiments, however, other magazine engagement configurations may be employed.

The reciprocating action of the lever cam 50 pivots the indexing lever 70 back and forth to locate the magazine engagement portion thereof between first and second positions in the magazine channel of the tool, alternately toward and away from the firing chamber.

In FIG. 2, when the sleeve 60 is extended by the spring 14, the magazine strip engagement portion of the indexing lever is positioned toward the firing chamber. And in FIG. 1, when the sleeve is depressed or compressed against the bias of the spring 14, the magazine strip engagement portion is positioned away from the firing chamber.

Figure 4:
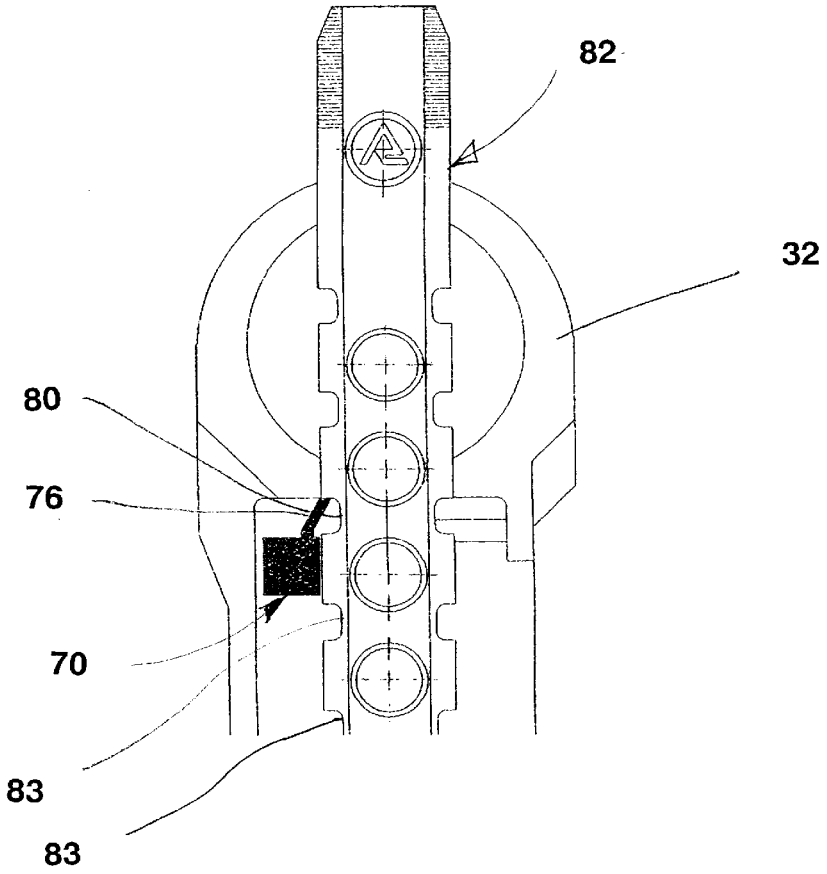
FIG. 4 is partial sectional view of the magazine strip indexing lever engaged with a magazine strip.

FIG. 4 illustrates the magazine engagement portion of the indexing lever and particularly the ratcheting tooth 76 thereof engaged with spaced apart notches 80 disposed along a side of the magazine strip 82.

The magazine strip is indexed upwardly in FIG. 4 as the indexing lever 70 moves from the position away from the firing chamber, illustrated in FIG. 1, to the position toward the firing chamber illustrated in FIG. 2. During this upward motion of the magazine engagement portion of the indexing lever, the tooth 76 thereof is spring biased into a notch of the magazine strip, notch 80 in FIG. 4, whereby the magazine strip is indexed upwardly.

As the magazine engagement portion of the indexing lever moves away from the firing chamber, from the position illustrated in FIG. 2 to the position illustrated in FIG. 1, the tooth 76 is withdrawn against its spring bias from the notch without moving the magazine strip downwardly. In FIG. 4, as the magazine engagement portion of the indexing lever moves downwardly, the magazine engagement portion is withdrawn from the notch 80 and is moved to a lower position, where it engages a lower notch 83 on the magazine strip 82.

The incremental indexing of the magazine strip thus proceeds with the reciprocation of the firing mechanism or other moving portion of the tool to which the indexing lever is coupled.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A compression triggered powder driven fastening tool comprising:

a magazine channel for engaging a magazine strip having a plurality of explosive cartridges;

a firing mechanism having a sleeve axially movable between first and second positions for detonating one of the plurality of explosive cartridges;

a lever cam rigidly coupled to the sleeve and movable therewith;

an indexing lever pivotally coupled to the tool;

wherein the lever cam and the indexing lever are separate parts;

the indexing lever having a magazine strip engagement portion extending into the magazine channel for indexing the magazine strip, the indexing lever having a cam follower portion cammingly engaged with the lever cam;

the magazine strip engagement portion of the indexing lever in a first position in the magazine channel when the sleeve is in the first position; and the magazine strip engagement portion of the indexing lever in a second position in the magazine channel when the sleeve is in the second position.

2. The tool of claim 1, the lever cam having a ramped cam slot, the cam follower portion includes a lever pin, whereby the indexing lever pivots as the lever pin follows the ramped cam slot of the lever cam.

3. The tool of claim 1, the indexing lever pivotally coupled to the tool by a pivot pin, the magazine strip engagement portion disposed on one side of the pivot pin and the cam follower disposed on another side of the pivot pin.

4. The tool of claim 3, the indexing lever pivoted to a first position locating the magazine strip engagement portion thereof in the first position in the magazine channel when the sleeve is in the first position, the indexing lever pivoted to a second position locating the magazine strip engagement portion thereof in the second position in the magazine channel when the sleeve is in the second position.

5. The tool of claim 1, a firing chamber positioned along the magazine channel between a breech end of a barrel and a breech block of the tool, the magazine strip engagement portion positioned toward the firing chamber when the sleeve is in the first position, the magazine strip engagement portion positioned away from the firing chamber when the sleeve is in the second position.

6. The tool of claim 5, the lever cam having a ramped cam slot, the cam follower portion is a lever pin disposed in the ramped cam slot of the lever cam, the lever pin is located at a first position along the ramped cam slot when the sleeve is in the first position, the lever pin is located at a second position along the ramped cam slot when the sleeve is in the second position.

7. The tool of claim 6, the indexing lever pivotally coupled to the tool by a pivot pin, the magazine strip engagement portion disposed on one side of the pivot pin and the lever pin disposed on an opposite side of the pivot pin, whereby the indexing lever pivots as the sleeve moves between the first and second positions.

8. The tool of claim 7, a spring disposed between the breech block and the sleeve, the spring biasing the sleeve to the first position, whereby the sleeve is movable to the second position against the spring bias.

9. The tool of claim 1, the sleeve of the firing mechanism aligned substantially axially with a barrel of the tool.

10. The tool of claim 9, the sleeve having a pole connector coupled thereto.

11. A powder driven fastener setting tool comprising:

a magazine channel for engaging a magazine strip having a plurality of explosive cartridges;

a lever cam rigidly coupled to a sleeve of the tool, the lever cam being movable between first and second positions;

an indexing lever pivotally coupled to the tool;

wherein the lever cam and the indexing lever are separate parts;

an engagement portion of the indexing lever extending into the magazine channel for indexing the magazine strip;

a cam follower portion of the indexing lever cammingly engaged with the lever cam as the lever cam moves between the first and second positions.

12. The tool of claim 11, the lever cam includes a ramped cam slot, the cam follower of the indexing lever is a lever pin disposed in the ramped cam slot.

13. The tool of claim 11, the indexing lever pivotally coupled to the tool by a pivot member, the engagement portion of the indexing lever disposed on one side of the pivot member and the lever pin disposed on another side of the pivot member.

14. The tool of claim 13, the indexing lever pivoted to locate the engagement portion thereof to the first position in the magazine channel when the lever cam is moved to the first position, the indexing lever pivoted to locate the engagement portion thereof to the second position in the magazine channel when the lever cam is moved to the second position.

15. The tool of claim 11, wherein the sleeve is aligned substantially axially with a barrel of the tool, and wherein the lever cam is coupled to the sleeve and movable therewith.

16. The tool of claim 15, the sleeve having a pole connector coupled thereto.

17. In a powder actuated fastener setting tool having a magazine strip of explosive cartridges fed through a channel to a firing chamber between a breech end of a barrel and a breech block, the tool triggered by a firing mechanism having a spring biased sleeve movable between first and second positions, the improvement comprising:

a lever cam rigidly coupled to the sleeve and movable therewith between first and second positions;

an indexing lever pivotally coupled to the tool;

wherein the lever cam and the indexing lever are separate parts;

a ratcheting magazine engagement portion of the indexing lever extending into the channel for indexing the magazine strip;

a cam follower portion of the indexing lever cammingly engaged with the lever cam as it moves between the first and second positions;

the magazine engagement portion of the indexing lever located in a first position in the channel when the lever cam is in the first position;

the magazine engagement portion of the indexing lever located in a second position in the channel when the lever cam is in the second position; and whereby the ratcheting magazine engagement portion of the indexing lever indexes the magazine strip of explosive cartridges through the channel as it moves between positions.

18. The improvement of claim 17, the lever cam having a ramped cam slot, the cam follower portion is a lever pin disposed in the ramped cam slot, the indexing lever pivotally coupled to the tool by a pivot pin, the magazine strip engagement portion disposed on one side of the pivot pin and the lever pin disposed on another side thereof.

19. The improvement of claim 17, a spring disposed between the breech block and the sleeve, the spring biasing the sleeve to the first position, the magazine strip engagement portion positioned toward the firing chamber when the sleeve is in the first position, the magazine strip engagement portion positioned away from the firing chamber when the sleeve is in the second position, whereby the sleeve is movable to the second position against the spring bias.

20. The improvement of claim 17, the sleeve of the firing mechanism aligned substantially axially with a barrel of the tool, the sleeve having a pole connector coupled thereto.

* * * * *